United States Patent [19]

Berthet et al.

[11] Patent Number: 4,708,526

[45] Date of Patent: Nov. 24, 1987

[54] CONNECTION SYSTEM BETWEEN A MAIN BODY AND A SUPER-STRUCTURE

[75] Inventors: Hubert Berthet; Noël Laugier, both of Arles, France

[73] Assignee: Institut Francais du Petrole, Rueil-Malmaison, France

[21] Appl. No.: 610,834

[22] Filed: May 16, 1984

[30] Foreign Application Priority Data

May 18, 1983 [FR] France ..... 83-08208

[51] Int. Cl.[4] ..... E02B 17/00

[52] U.S. Cl. ..... 405/202; 405/203

[58] Field of Search ..... 405/195, 202, 203, 204, 405/205, 207

[56] References Cited

U.S. PATENT DOCUMENTS 720,998 2/1903 Becker ..... 405/202

3,352,269 11/1967 Dollison ..... 405/205 X

*Primary Examiner*—David H. Corbin

*Attorney, Agent, or Firm*—Antonelli, Terry & Wands

[57] ABSTRACT

A connection system between a main body and a superstructure, usable in a sea environment, comprising an arrangement for moving the main body relatively to the superstructure and, guide means cooperating with said moving arrangement. The moving means arrangement is inscribed on a cylindrical surface, was the guide and moving arrangment being adapted to allow at least a swinging movement of main body relatively to said superstructure.

15 Claims, 13 Drawing Figures

CONNECTION SYSTEM BETWEEN A MAIN BODY AND A SUPER-STRUCTURE

BACKGROUND OF THE INVENTION

The present invention relates to an original connection system between a main body, such as a platform, a buoy or a column, operable at sea, and a superstructure such as a deck carrying the equipment.

Generally, the platform, buoy or column is formed from at least one element having a general oblong shape, such as that of a cylinder whose height is greater than the diameter. For reasons of stability at sea, this cylinder is generally in a vertical position in operation. The weight of the main body may reach several thousands of tons.

The deck supports the equipment such as the flare, helideck, living quarters, manifolds, separators etc . . . ; its weight may reach some thousands of tons. Taking into account its equipment, the deck must remain in a horizontal position.

The deck is generally positioned in the following way:

The main body, constructed in a horizontal position, is placed in the vertical position by ballasting, and the deck, loaded on a barge, is brought above the main body which is then unballasted so as to allow engagement between the deck and the main body.

The above operation must be performed in a sheltered zone so as to limit the engagement stresses which would be prohibitive out at sea. This assumes then that the deck-main body assembly is towed in vertical position to the site. If required, changing the operation site is effected in the same manner.

Typical prior art constructions of the aforementioned type are disposed in, for example, French patent applications or certificate of addition numbers: 2 298 471, 2 359 248 and 2 384 902 and British Pat. No. 1 525 242.

More precisely, the present invention relates to a connection system between a main body and a superstructure, which may be used in a sea environment, with the connection system comprising means for moving said main body relatively to said superstructure and guide means cooperating with said moving means. The moving means may be inscribed on a cylindrical surface, with the moving and guide means being adapted to allow at least a swinging movement of the main body relatively to the superstructure.

With a main body formed by at least one element having an oblong shape, the connection system of the invention may comprise at least one guide element, such as a rail or a slide, whose form is inscribed substantially on a cylinder, with an axis of the cylinder being perpendicular to the axis defined by an elongation direction of the element with oblong shape of said main body. The guide element will be fixed rigidly to the main body, as well as moving means, such as rolling means or shoes cooperating with with the guide element, said moving means being fixed to the lower parts of said superstructure. In this case, it is not imperative for the axis of the above defined cylinder and the axis of the main body to be concurrent. Without departing from the spirit of the present invention, the guide element may be fixed to the superstructure and the moving means to the main body. The same is true when several guide elements are used, which may be distributed between the superstructure and the main body and of course the moving means will be distributed accordingly. The rolling means may comprise bodies equipped, if need be, with tires which may be inflatable. The moving means may comprise drive means driven by control means adapted to maintain the superstructure in a substantially fixed position in space, or to control movement thereof in space during swinging of the main body.

More particularly, in the case where the superstructure is a deck, the control means may be adapted to maintain the deck in a substantially horizontal position during the swinging operation of the main body.

A system of slings and hoisting gear or a rack and pinion system or equivalent means, such as hydraulic cylinders or jacks connecting the main body and the superstructure together may control the fixed position in space of said superstructure. Such a system may be controlled so as to hold the superstructure in a fixed position in space during the swinging operation of the main body.

Whether the system of the invention comprises drive means, or sling systems, or equivalent means, the operation for positioning or removing the same may comprise several steps, each comprising simultaneous swinging of the superstructure and of the main body through a limited angle and movement of the superstructure with respect to the main body. This movement may have an amplitude sufficient for compensating and/or anticipating at least partially the preceding limited angle swinging and/or following on this operation of moving the superstructure with respect to the main body.

In some variants, the connection system may comprise several guide elements whose shape is inscribed on the same straight axis cylinder, with each of these guide elements being situated in a plane perpendicular to the axis of the cylinder. In one advantageous embodiment, the connection system comprises three guide elements and the corresponding rolling means.

More particularly for reasons of convenience of construction, the guide elements may have a closed circular shape.

The connection system of the invention, when it is applied to a connection between a deck and a main body, presents a number of significant advantages.

More particularly, by virtue of the present invention, it is possible to form a temporary connection in a sheltered zone between the secondary installation in a horizontal position and the main body in a substantially horizontal position, Additionally, it is possible to tow the deck-main body assembly in a substantially horizontal position to the operating site, Moreover, with the present invention, it is possible to place the main body in a vertical position by ballasting, with the deck remaining in a horizontal position in all of the phases of ballasting of the main body, The present invention also provides the possibility of permanently locking the deck to the main body, and, the reversibility of each operation, allows a change in the operating site.

BRIEF DESCRIPTION OF THE DRAWINGS

The present invention will be better understood and its advantages will become more apparent from the following description of a particular embodiment, which is in no wise limiting, illustrated by the accompanying drawings in which.

DETAILED DESCRIPTION

Figure 1A:
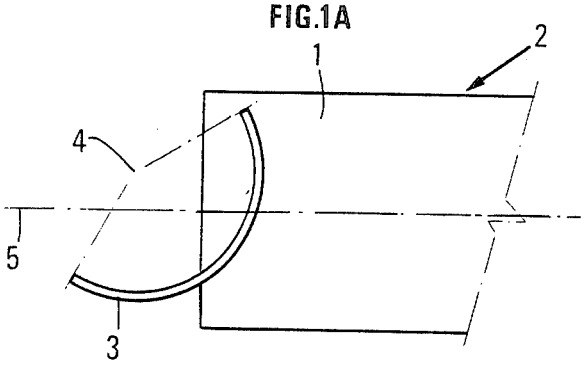
FIGS. 1A and 1B are schematic views of a part of the main body equipped with rails.
Figure 1B:
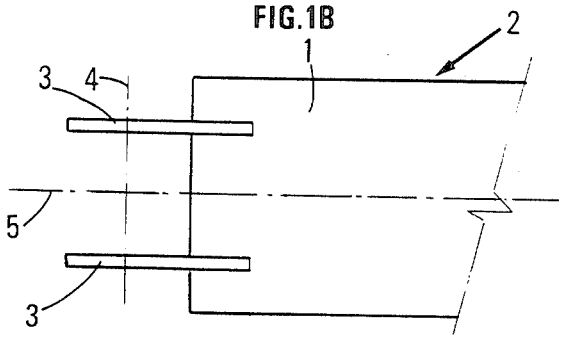
Figure 2:
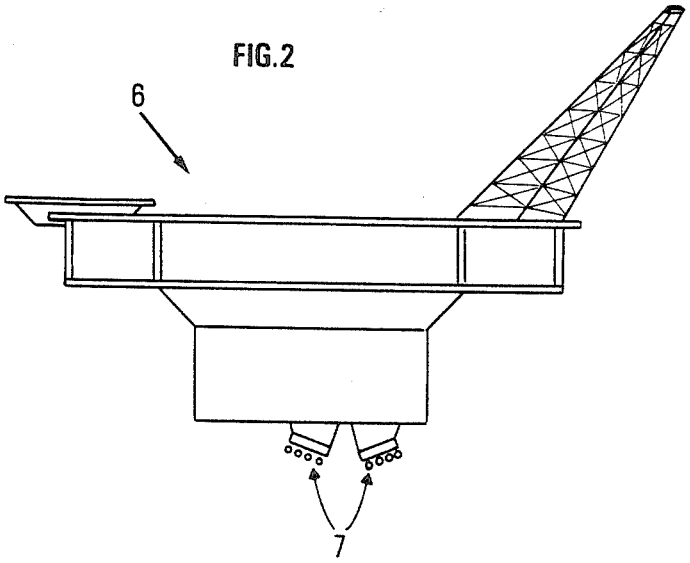
FIG. 2 is a schematic side view of a superstructure equipped with rolling means.

Referring now to the drawings wherein like reference numerals are used throughout the various views to designate like parts and, more particularly, to FIGS. 1A, 1B and 2, as shown in these figures, a connection system is provided between a platform, a buoy, column, or more generally a floating cylindrical body generally designated by the reference numeral 2, at least during positioning thereof (even if in operation the main body is fixed to the sea bed), and a deck 6 generally designated by the reference numeral 6 supporting equipment such as, for example, flare, helideck 10, living quarters, manifolds, separators, etc . . . or any other equipment.

As shown in FIGS. 1A, 1B, the upper end 1 of the main body 2, which may be cylindrical or have any other shape, is equipped with one or more cylindrical shaped rails 3 (or slides). In FIGS. 1A, 1B, the rails 3 are positioned on the same cylinder whose axis 4 is horizontal and perpendicular to the longitudinal center axis 5 of the main floating cylindrical body 2 forming the main body. These two axes are not necessarily concurrent.

Figure 8:
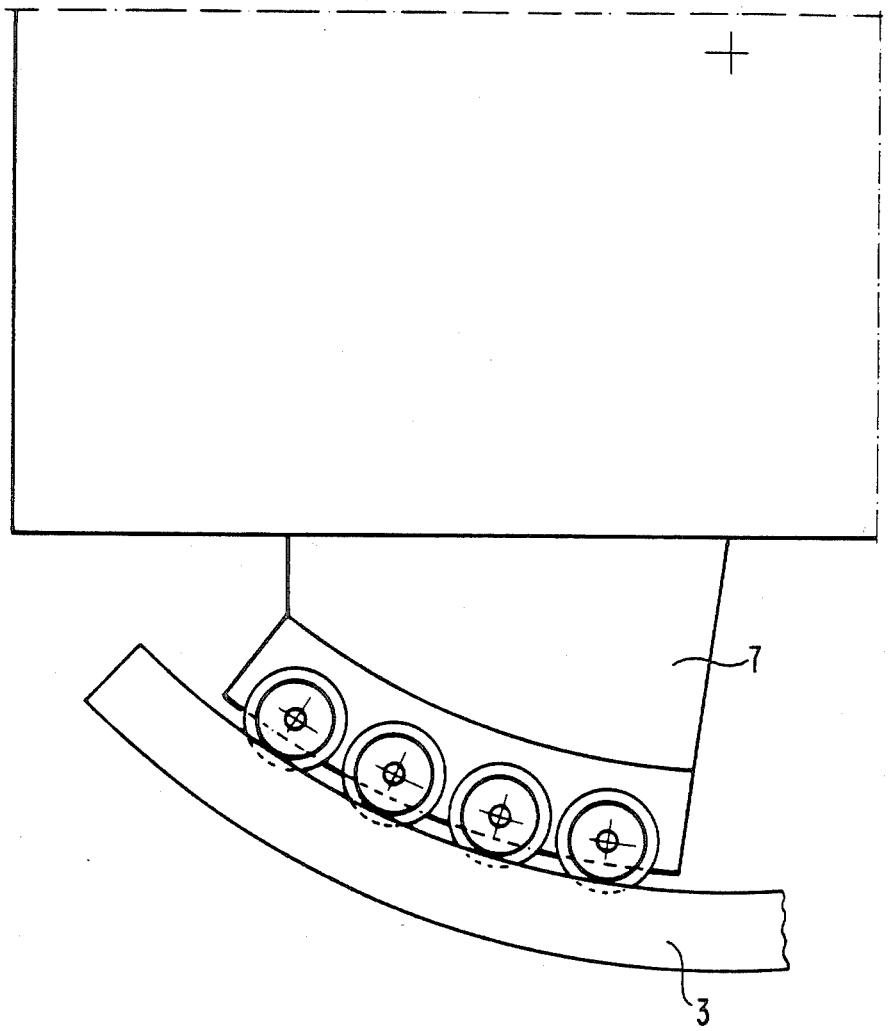
FIG. 8 is an enlarged schematic view of the rail and bogey arrangement.
Figure 9:
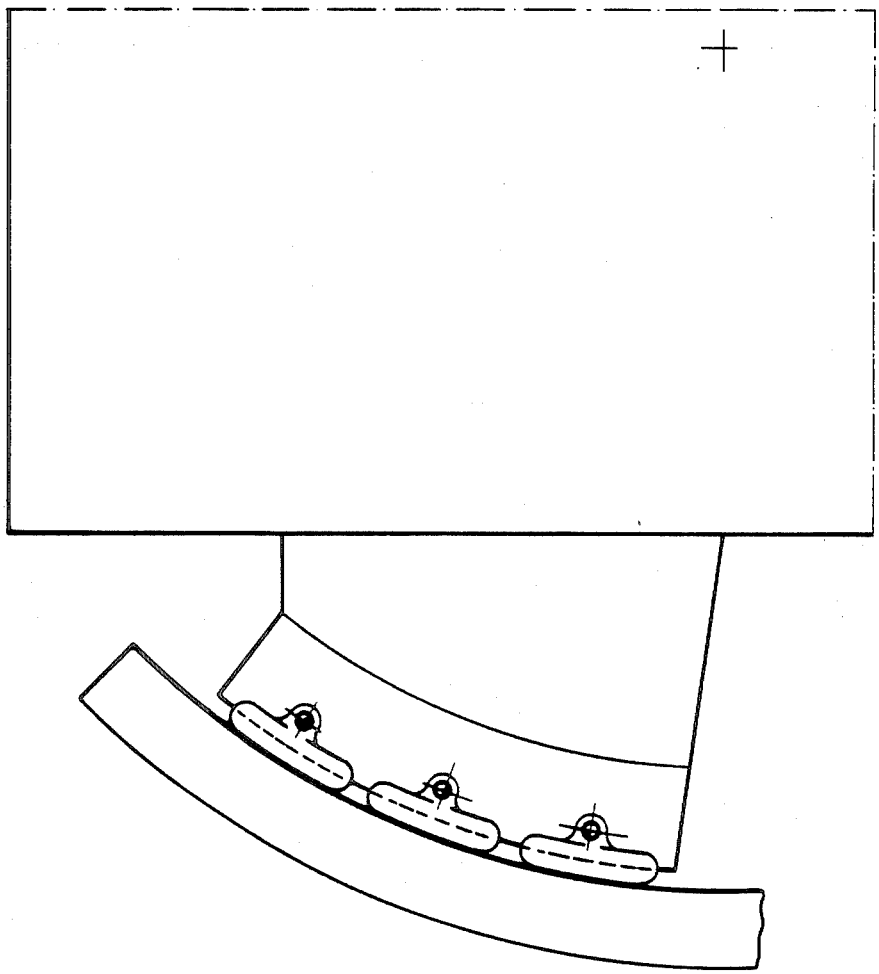
FIG. 9 is a schematic view of a shoe and guide means arrangement.

The lower part of the superstructure, which in FIGS. 2 to 6, is a deck 6, is equipped with bogies 7 or any other system allowing a heavy load to move on rails 3, such as, for example, shoes as shown in FIG. 9, which may be hinged or not, disposed so as to bear on rails 3 as shown in an enlarged view in FIG. 8.

The bogies 7 or any other equivalent system, are provided with all the conventional devices required for taking up the secondary stresses, such as side rollers, counter rollers, etc . . . and, since these devices are known to one skilled in the art, they will not be further described.

Figure 3:
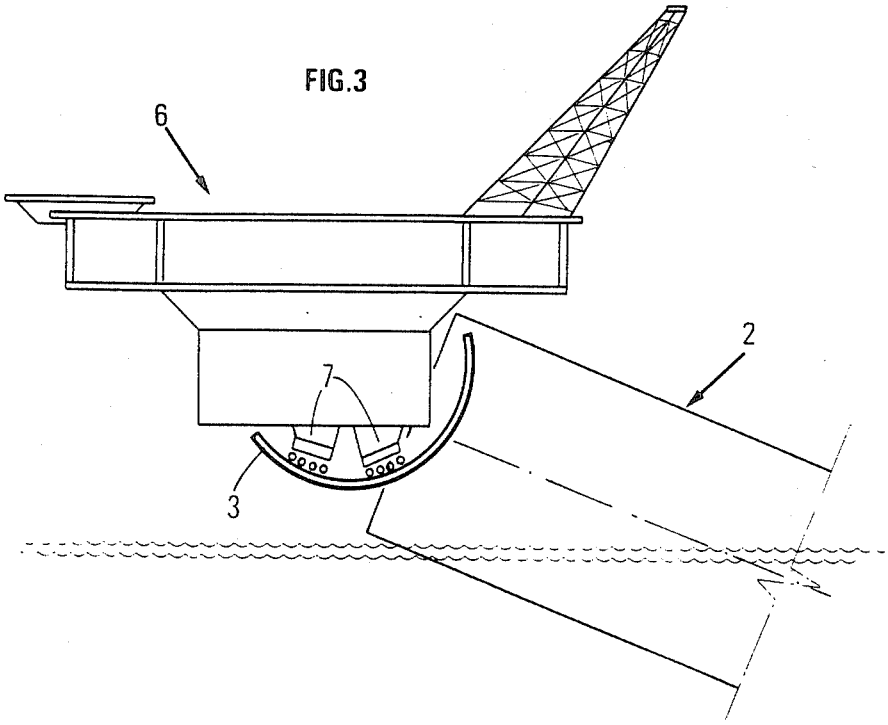
FIGS. 3 to 5 illustrate the positioning of the main body.

In addition, the bogies 7 may be equipped with a rack, or chain drive system or any other suitable means for allowing the bogies to move over rails 3. The bogies 7 may be motorized, and the drive system may be controlled so as to maintain the deck in a fixed position, such as for example, a horizontal position. After the floating cylindrical body 2 has been set afloat, in a substantially horizontal position, the deck 6 may be placed on rails 3 of the cylindrical body 2. Still within the scope of the invention, the deck 6 may be assembled directly on the connection system. A temporary fixing device may secure bogies 7 against movement on rails 3. The deck 6 and cylindrical body 2 assembly may then be towed to the operating site (as shown in FIG. 3).

Figure 4:
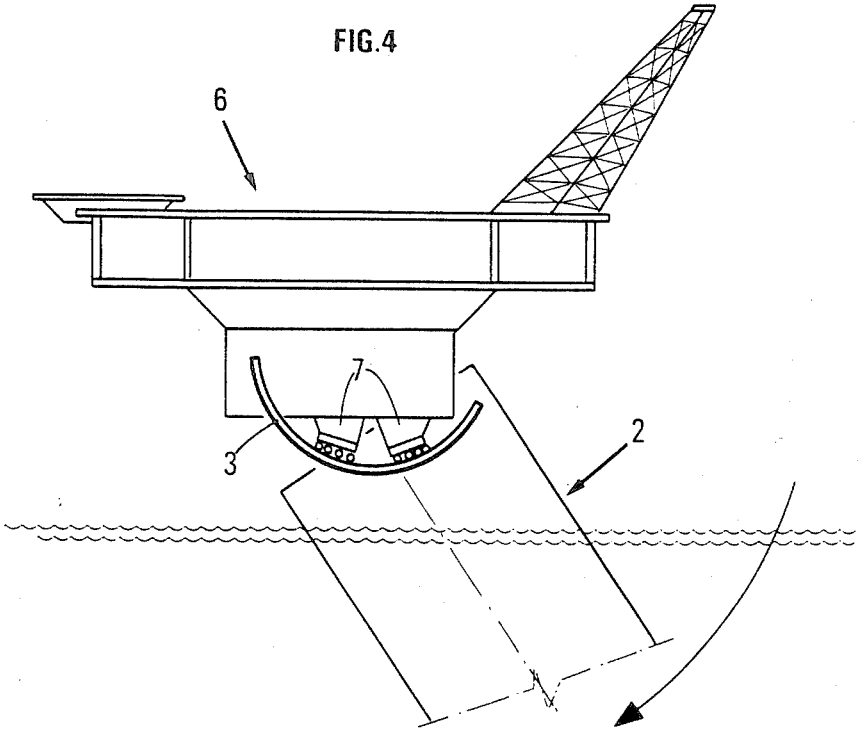
Figure 5:
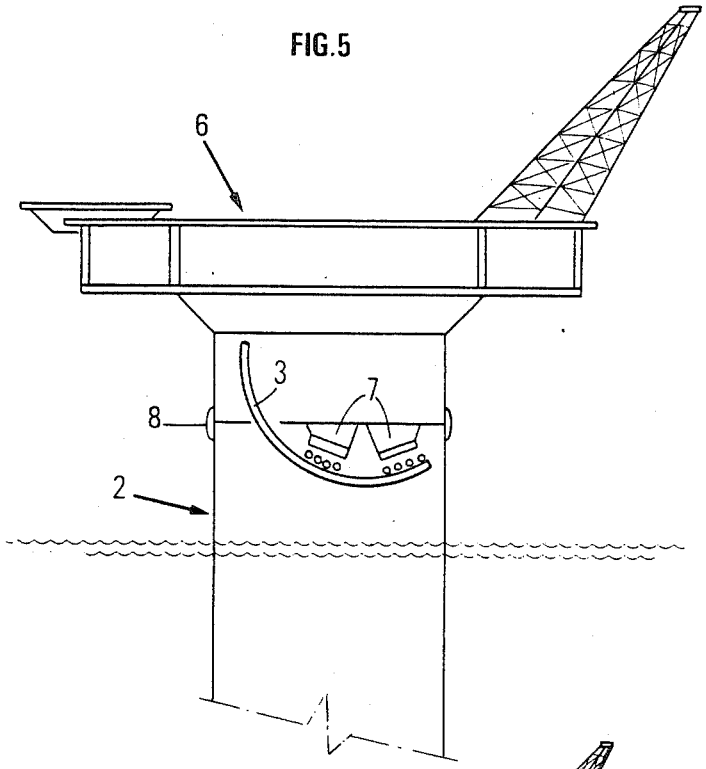

Once on the site, the temporary connection connecting bogie 7 to rails 3 is removed, the cylindrical body 2 is then placed in a vertical position by ballasting, with deck 6 remaining in a horizontal position, possibly through the slaved control of the bogies as shown in FIG. 4.

When the cylindrical body 2 is in a vertical position, the bogies 7 are fixed to rails 3 by a temporary fixing device, then the final fixing means 8 are placed in position.

Should it be required to change the operating site, the different positioning phases may be performed in the reverse direction. The essential advantage of this solution is to do away with the stresses in coupling the movement of the deck 6 to the movement of the body 2.

Figure 6:
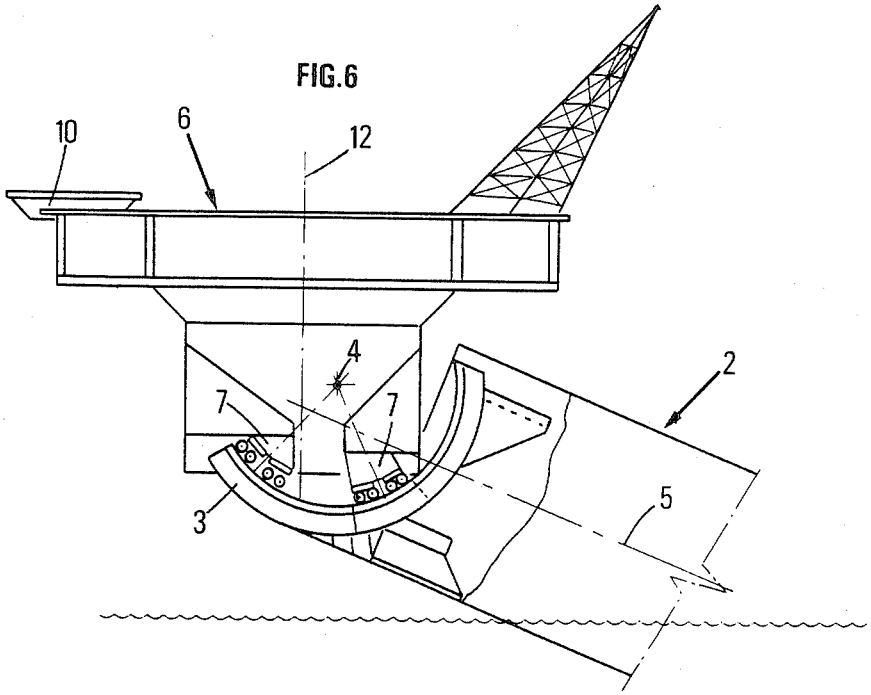
FIG. 6 is a schematic view of a connection system comprising three rails.
Figure 6A:
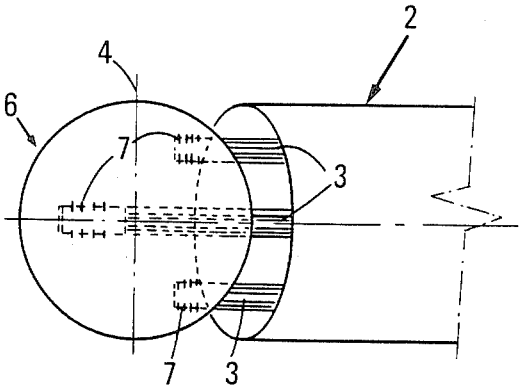
FIG. 6A is a schematic detail view, on an enlarged scale, of a connection system of FIG. 6, and FIG. 7 a schematic view of a connection system comprising a sling and hoisting gear system.

A particularly advantageous arrangement of the connection system is shown in FIGS. 6 and 6*a*, wherein the system is formed from an assembly of three rails 3 hinged about a hinged axis 4 and three bogies 7 with the whole of the connection system being housed in a cylindrical casing.

Figure 7:
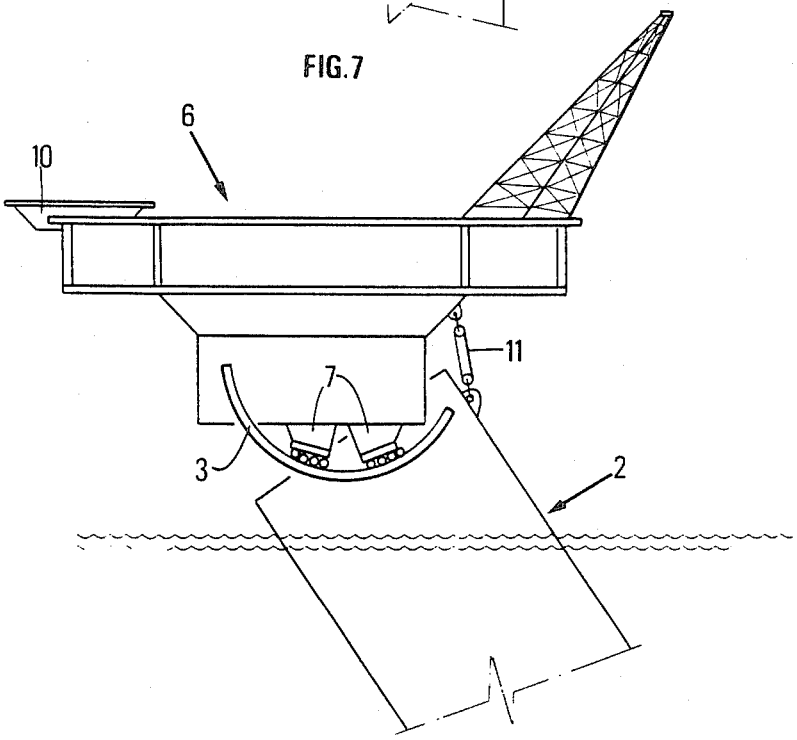

As shown in FIG. 7, the time of deck 6 may be controlled by a sling and hoisting gear system 11 or equivalent means, such as hydraulic cylinders or jacks connecting the body 2 and the deck 6 together.

Figure 11:
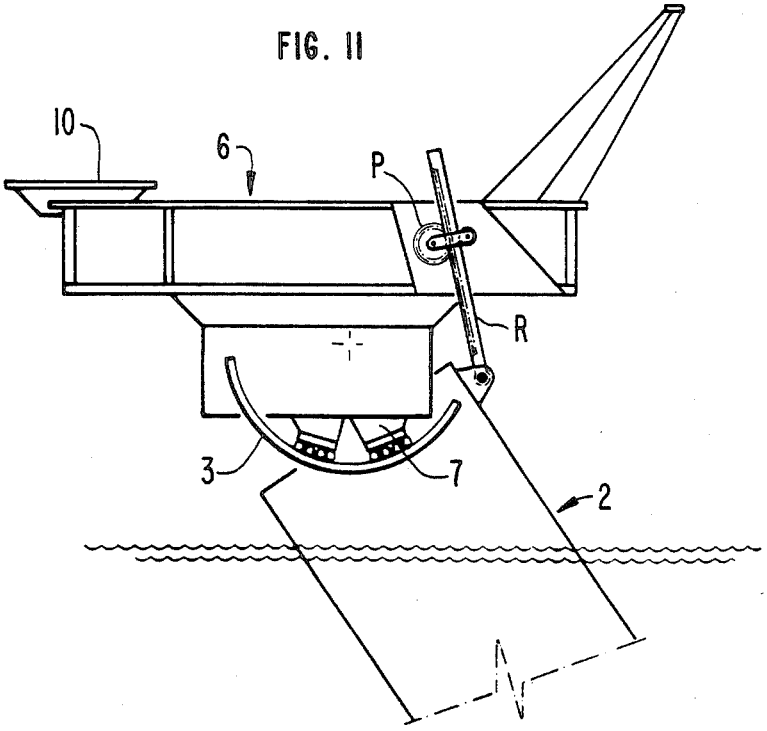
FIG. 11 is a schematic view of a rack and pinion system.

Still within the scope of the invention, as shown in FIG. 11, the connection system between a body 2 and a superstructure, such as the deck 6, may further comprise moving means and guide means, with a device for controlling the trim of the deck 6 having at least a rack and at least a pinion cooperating with the rack, which pinion is adapted to be connected to activation means and/or braking means. The activation means and/or braking means may be in the form of hydraulic, electric, or thermal motors, etc.

Without departing from the scope of the invention, the rails 3 may have a form other than the one described above such as, for example, a form which would allow the deck 6 to rotate about its axis 12 relatively to the body 2 during swinging of the latter.

Figure 10:
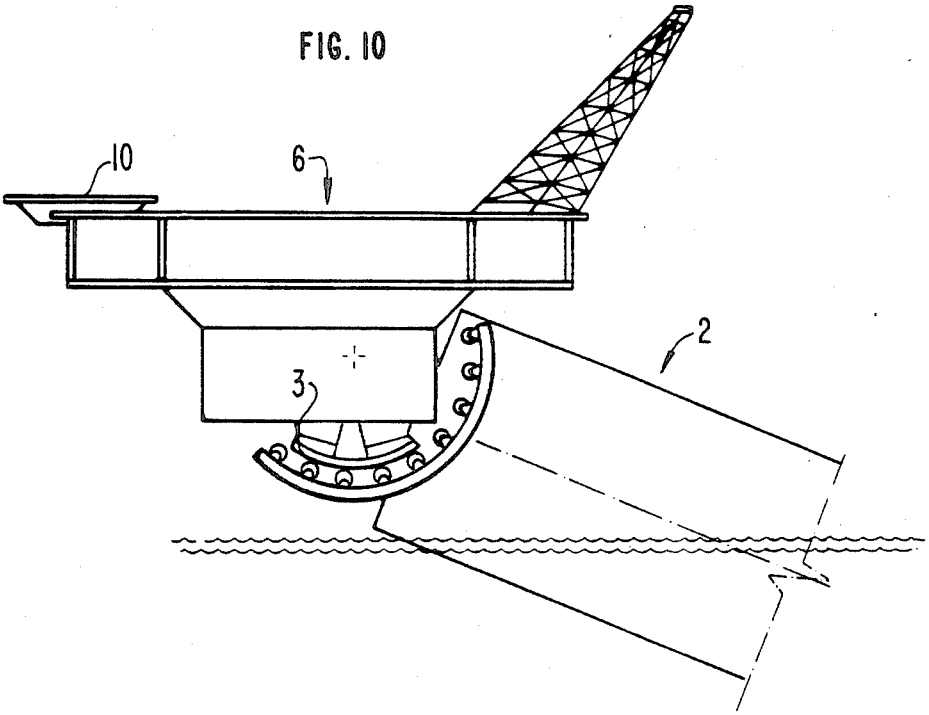
FIG. 10 is a schematic view of a connection system comprising rails equipped with rolling means.

Still within the scope of the present invention, as shown in FIG. 10, several rails 3 may be used whose shape is inscribed on at least one cylinder having an axis perpendicular to the axis defined by the direction of the element of oblong shape, however, in the case where the different rails 3 are inscribed on different cylinders, the latter will be coaxial.

What is claimed is:

1. A connection system between a floating main body and a superstructure adapted to be used in a sea environment, comprising means for moving said floating main body relative to said superstructure, and guide means cooperating with said moving means, wherein said moving means are inscribed on a cylindrical surface, and wherein said guide means and said moving means are adapted to allow at least a swinging movement of said main floating body relative to said superstructure.

2. The connection system as claimed in claim 1, wherein said moving means comprise rolling means and said guide means comprise at least one guide element such as a rail.

3. The connection system as claimed in claim 1, wherein said moving means comprise shoes, and wherein said guide means comprise at least one slide guide element.

4. The connection system as claimed in one of claims 2 or 3, wherein said floating main body has at least one element with an oblong shape, further comprising at least one guide element whose shape is inscribed substantially on a cylinder, an axis of said cylinder being perpendicular to an axis defined by an elongation direction of said oblong shaped element of said floating main body, said guide element being rigidly fixed to said floating main body and moving means fixed to a lower part of the super structure for cooperation with said guide element.

5. The connection system as claimed in one of claims 2 or 3 wherein said floating main body has at least one element with an oblong shape, further comprising at least one guide element whose shape is inscribed substantially on a cylinder, an axis of said cylinder being perpendicular to an axis defined by an elongation direction of said oblong shaped element of said floating main body, said guide elements being rigidly fixed to said superstructure, and moving means fixed to a lower part of said floating main body for cooperation with said guide element.

6. The connection system as claimed in one of claims 2 or 3, wherein said floating main body has at least one element with an oblong shape, further comprising a plurality of guide elements whose shape is inscribed substantially on at least one cylinder, an axis of said cylinder being perpendicular to an axis defined by an elongation direction of said oblong shaped element of said floating main body, at least one of said guide elements being rigidly fixed to said floating main body, with the other guide elements being rigidly fixed to said superstructure, and moving means cooperating with said guide elements and distributed accordingly.

7. The system as claims in claim 1, wherein said moving means comprises motive means.

8. The system as claimed in claim 7, further comprising means for controlling said motive means adapted to maintain said superstructure in a substantially fixed position in space during a swinging of said floating main body with respect to said superstructure.

9. The system as claimed in claim 7, further comprising means for controlling said motive means adapted for controlling the movement in space of said superstructure during swinging of said floating main body with respect to said superstructure.

10. The system as claimed in claim 1, further comprising a system of slings and hoisting gear connecting said floating main body and said superstructure together.

11. The system as claimed in claim 3, further comprising several guide elements whose shape is inscribed on the same cylinder, each of said guide elements being situated in a plane perpendicular to axis of said cylinder.

12. The system as claimed in claim 11, further comprising three guide elements and corresponding moving means.

13. The system as claimed in claim 1, further comprising at least one rack and at least one pinion, cooperating with said rack.

14. A process for positioning or removing the system described in claim 1, comprising the following steps, comprising simultaneous swinging of the superstructure of the floating main body through a limited angle, and moving the superstructure with respect to said floating main body, said movement having an amplitude sufficient for compensating and/or anticipating at least partially a preceding limited angle swing and/or following this operation for moving the superstructure with respect to said floating main body.

15. The system as claimed in claim 1, further comprising hydraulic cylinders of jacks connecting said floating main body and said superstructure together.

* * * * *